United States Patent [19]

Watson

[11] 4,080,086

[45] Mar. 21, 1978

[54] ROADWAY JOINT-SEALING APPARATUS

[75] Inventor: Steward Charles Watson, Williamsville, N.Y.

[73] Assignee: Watson-Bowman Associates, Inc., Buffalo, N.Y.

[21] Appl. No.: 616,140

[22] Filed: Sep. 24, 1975

[51] Int. Cl.[2] ..... E01C 11/02

[52] U.S. Cl. ..... 404/69

[58] Field of Search ..... 404/68, 67, 69, 47, 404/48; 52/396, 403; 49/475

[56] References Cited

U.S. PATENT DOCUMENTS

| | | | |
|---|---|---|---|
| 1,474,481 | 11/1923 | King | 404/19 |
| 1,581,345 | 4/1926 | Healy | 404/41 X |
| 2,228,052 | 1/1941 | Gardner | 404/64 X |
| 3,172,237 | 3/1965 | Bradley | 404/64 X |
| 3,375,763 | 4/1968 | Welch | 404/67 X |
| 3,387,544 | 6/1968 | MacLellan | 404/68 X |
| 3,396,640 | 8/1968 | Fujihara | 404/67 |
| 3,418,898 | 12/1968 | Cimini | 404/67 X |
| 3,713,368 | 1/1973 | McDowell | 404/67 |
| 3,814,530 | 6/1974 | Neff | 404/67 |
| 3,838,931 | 10/1974 | Valla | 404/69 |
| 3,862,810 | 1/1975 | Welch | 404/47 X |
| 3,880,539 | 4/1975 | Brown | 404/68 X |
| 3,881,835 | 5/1975 | Moerr | 404/64 |

FOREIGN PATENT DOCUMENTS

| | | | |
|---|---|---|---|
| 1,350,903 | 4/1974 | United Kingdom | 404/68 |

*Primary Examiner*—Nile C. Byers

*Attorney, Agent, or Firm*—Ashlan F. Harlan, Jr.

[57] ABSTRACT

Sealing apparatus for joints in roadways which comprises elongated anchor pads secured by studs and nuts to the surfaces of concrete slabs on opposite sides of a gap therebetween and a flexible, resilient, elongated, sealing member extending between and integral with said pads, said pads preferably being formed of a relatively hard elastomeric material having rock fragments embedded therein and reinforced by longitudinally extending metal plates therein. Means is provided for connecting sections of said sealing apparatus end-to-end and preventing leakage at their contacting ends.

9 Claims, 15 Drawing Figures

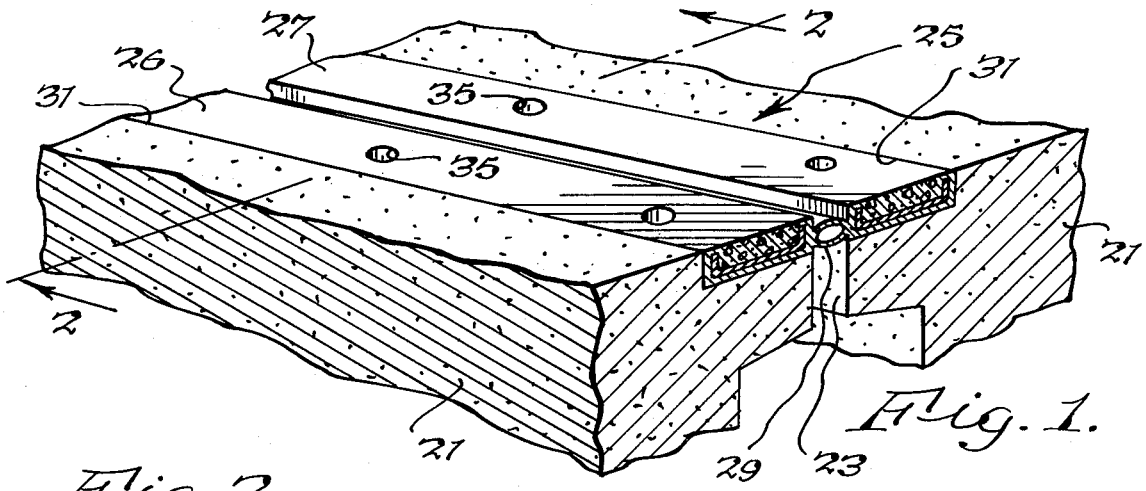
Fig. 1.
Fig. 2.
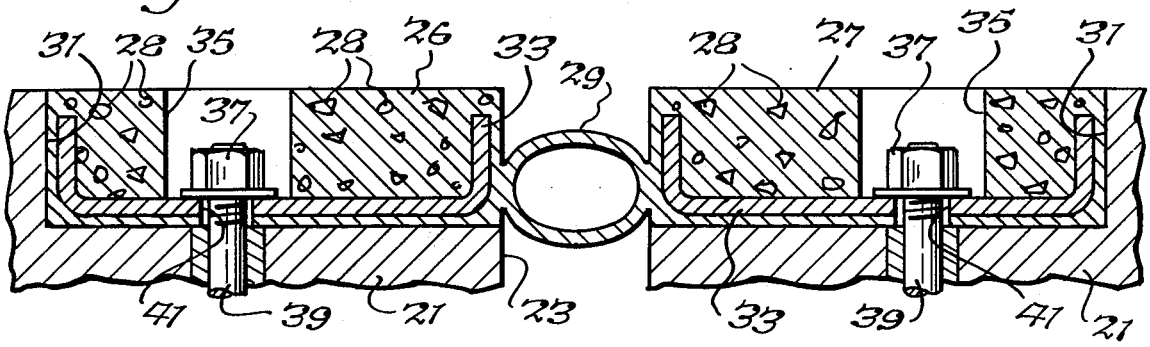
Fig. 3.
Fig. 3a.
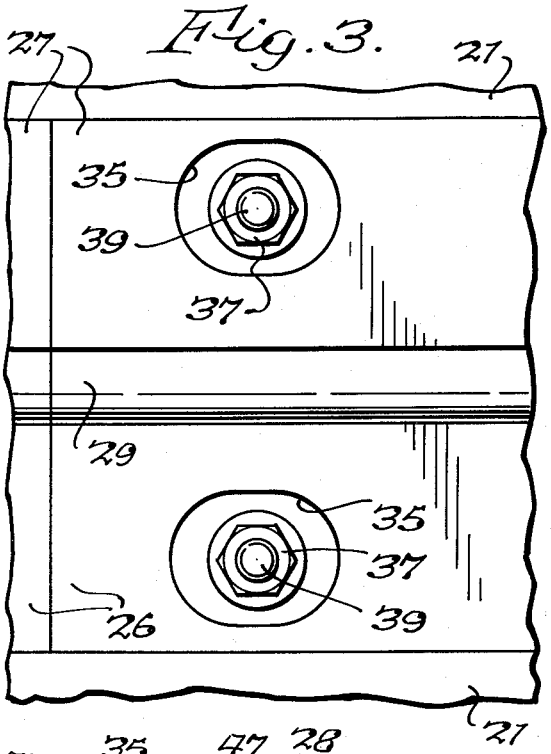
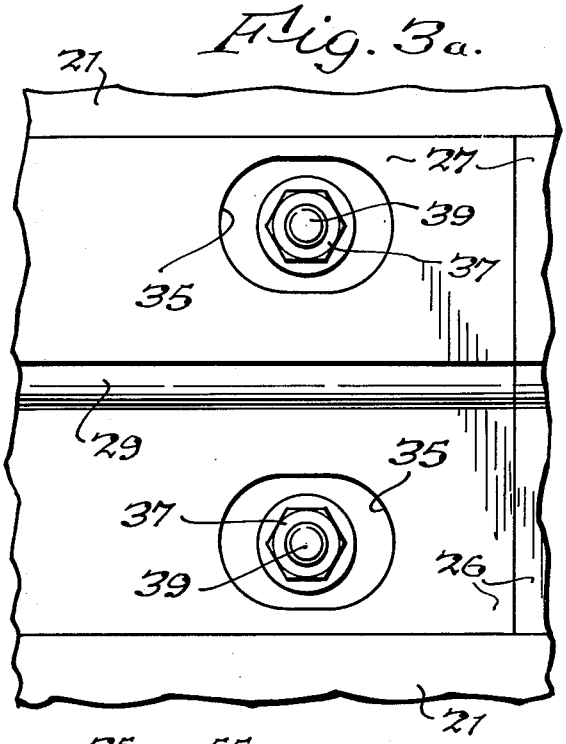
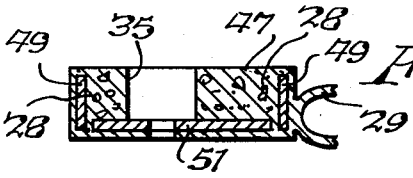
Fig. 4.
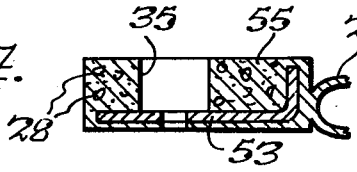
Fig. 5.

Fig. 14.
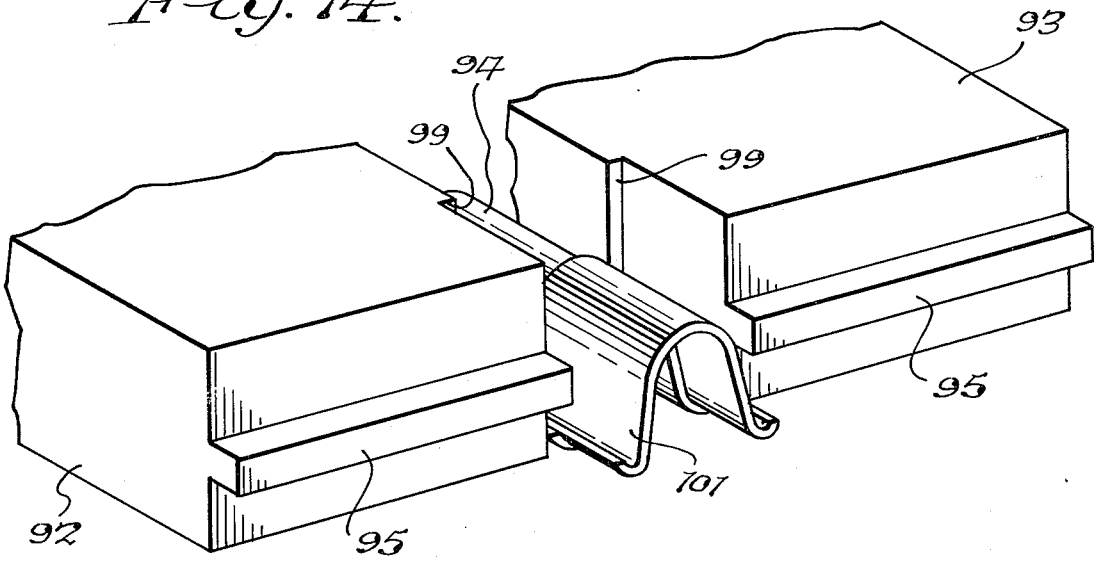
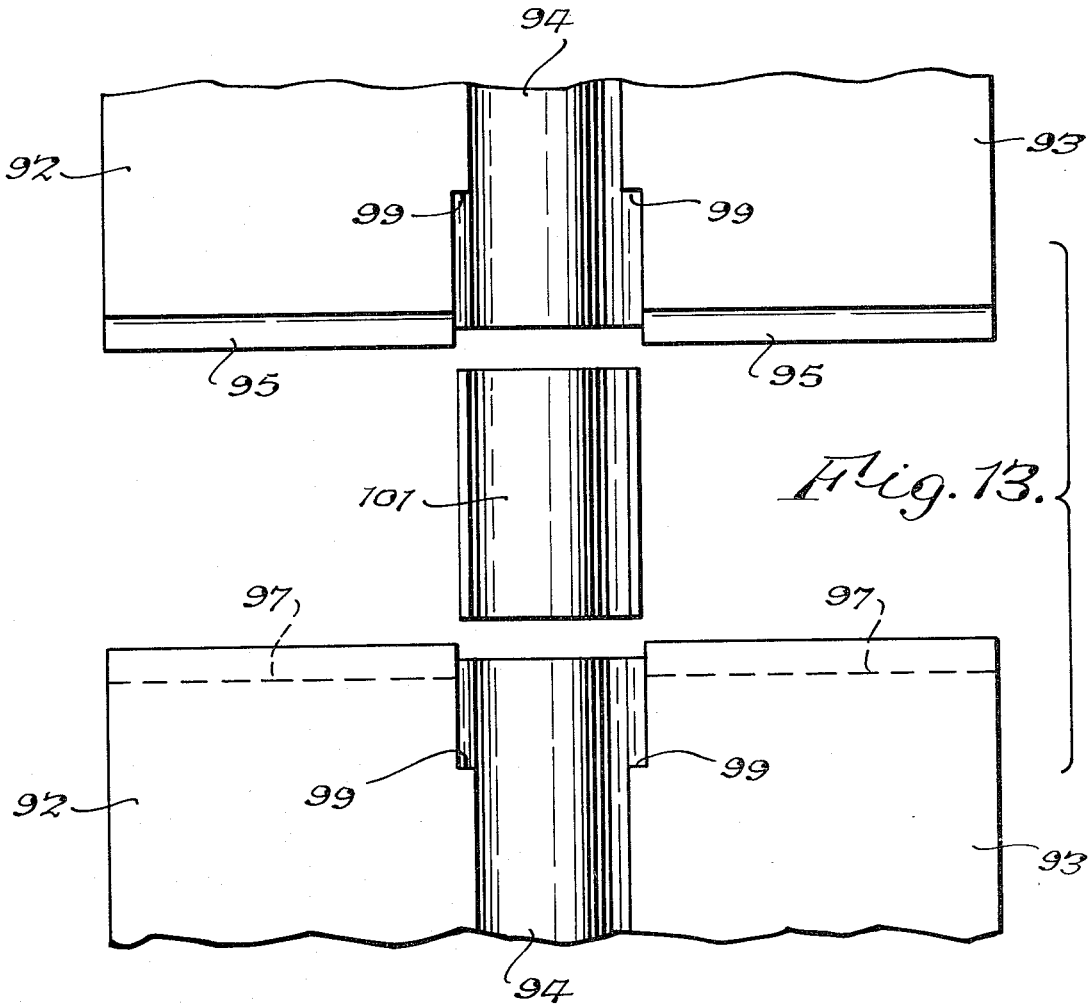
Fig. 13.

ROADWAY JOINT-SEALING APPARATUS

BACKGROUND OF THE INVENTION

The invention of the present application relates to improvements in joint-sealing apparatus for roadways and is particularly concerned with apparatus of that type for use on bridges, overpasses and the like.

Modern highways including bridges, overpasses and the like are in many cases formed of concrete slabs. Such slabs, as a result of changes in temperature, expand and contract. To prevent buckling or heaving on expansion, gaps must be provided between the slabs. However, such gaps permit entrance of debris such as stones and dirt as well as water. The debris and the water, when the latter is frozen, may interfere with expansion of the concrete slabs and/or cause cracking or chipping of the adjacent concrete surfaces. When, as is frequently the case, the roadway is elevated, for example, on a bridge instead of resting on a stone foundation, the leakage of water through the gaps on objects or people below is also a problem.

On concrete roads supported on the ground surface, the gaps at joints in the roadway are conveniently closed by elongated, resilient, hollow sealing members. Where, however, the roadway is supported in the air, for example on bridges, elevated highways, and the like, there is not only movement of the concrete slabs in a horizontal plane, but also at times, as a result of variation in loading, the slabs move vertically with respect to one another. Sealing of the joint gaps under such conditions is a much more difficult matter. Not only is it desired to seal the gaps from leakage of liquids, primarily water, and accumulation of debris, but also to reduce noise occasioned by traffic passing over the gaps, to protect the edges of the slabs from spalling, and to maintain firm surfaces adjacent the gaps so that vehicle wheels pass easily over the gaps without excessive deformation of the sealing apparatus. Many efforts have been made to satisfactorily seal such gaps. Examples of such efforts are disclosed in U.S. Pat. Nos. 3,850,539 and 3,713,368, but the results are not entirely satisfactory in some types of installations.

It is an object of the present invention to provide sealing apparatus suitable for use in roadway joint-gaps on bridges and the like which not only provides proper sealing of the gap within a considerable range of relative movement of the adjacent concrete slabs, but which also resists deformation by heavy loads and wear by traffic.

SUMMARY OF THE INVENTION

The above-mentioned object is achieved by providing sealing apparatus comprising a pair of elongated anchor pads secured to the concrete slab surfaces on opposite sides of a gap therebetween and a flexible, resilient, elongated, sealing member extending between said pads and preventing entrance of extraneous material into said gap. The anchor pads are preferably formed of an elastomeric material such as relatively hard rubber or neoprene, have longitudinally extending reinforcing metal plates or bars therein, and have embedded in the elastomeric material fragments of crushed rock to add to their wear resistance. The pads are secured to the slabs by studs and nuts, the studs being mounted at intervals in the slabs and extending into holes provided in the pads. The elongated, flexible sealing members extending between the anchor pads are preferably molded or otherwise formed integrally with the pads, and the sealing apparatus is preferably formed in sections of suitable lengths for ease in molding and in handling and installation. When more than one section of the sealing apparatus is required to seal a joint gap, a plurality of sections of such apparatus can be arranged in end-to-end relation. Means is disclosed for connecting said sections of sealing apparatus at their contacting ends and preventing leakage therebetween.

BRIEF DESCRIPTION OF THE DRAWINGS

FIG. 1 is a fragmentary perspective view, partially in section, showing joint-gap sealing apparatus in accordance with the present invention installed in a pavement;

FIG. 2 is an enlarged cross-sectional view taken on line 2—2 of FIG. 1;

FIG. 3 is an enlarged, fragmentary top plan view of a portion of sealing apparatus according to the present invention, as illustrated in FIG. 1, showing the flexible sealing member under tension;

FIG. 3*a* is a view identical with FIG. 3, but with the flexible sealing member shown under compression;

FIGS. 4 and 5 are fragmentary, reduced, sectional views illustrating variations in the means for reinforcing the anchor pads;

FIG. 13 is an exploded view showing, in plan, another method of preventing leakage between sections of the sealing apparatus; and FIG. 14 is an end view of a section of the sealing apparatus shown in FIG. 13 with an auxiliary sealing device in place.

THE INVENTION

Figure 6:
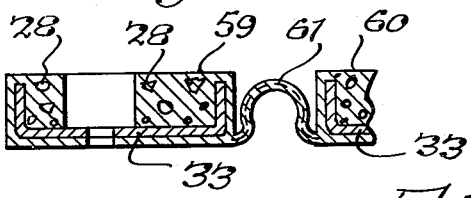
FIGS. 6 and 7 are fragmentary, reduced, sectional views illustrating variations in the design of the flexible sealing member joining the anchor pads.

The terms "upper", "lower", "top", "bottom", "right", "left", "above", "below", "vertical", and "horizontal", and similar terms of position and/or direction as used hereinafter refer to the illustrations in the drawings, but are used only for convenience in description and/or reference. Such terms should not be so construed as to imply a necessary positioning of the structure or portions thereof or to limit the scope of this invention.

In FIG. 1 there is shown a portion of a roadway embodying the joint-gap sealing apparatus of the present invention. As illustrated, the concrete slabs 21 are separated by a vertical gap 23. The sealing apparatus for the gap 23, designated generally by the numeral 25, comprises a pair of horizontally spaced, substantially parallel, elongated, anchor pads 26 and 27 joined by a longitudinally extending, flexible, resilient sealing member 29 integrally formed therewith.

The anchor pads 26 and 27 may be respectively secured, as explained below, in step-like recesses 31 provided in the slabs 21 on opposite sides of the gap 23. Each pad comprises a resilient body of a suitable elastomeric material in which are embedded a plurality of large, hard particles 28, for example, fragments of coarsely crushed rock. The rock fragments preferably are bonded by the elastomeric material. Extending longitudinally within each pad 26 and 27 is a reinforcing plate, formed as a channel 33, the base thereof lying close to the bottom of the pad and the upstanding legs lying closely adjacent the side faces of the pad. At spaced intervals along the length of the pads 26 and 27, vertical bores or wells 35 are provided. These are adapted to receive nuts 37 that are threadedly secured to studs 39, embedded in the slabs 21, that extend upwardly through holes 41 in the channel plates 33 and the lower surfaces of the pads 26 and 27 into the wells.

As stated above, the elongated, flexible, sealing member 29 is preferably integral with the anchor pads 26 and 27. The former is essentially a tube formed of flexible and resilient elastomer which preferably is not as hard as the elastomer from which the pads 26 and 27 are formed. The tube may be circular or, as shown, somewhat elliptical in cross section, and is joined to the anchor pads at diametrically opposite points. It will be understood that the shape of the sealing member 29, as just described and as illustrated in FIGS. 1 and 2, is that of the member in unstressed state, since in use the shape varies with the force applied thereto. This is indicated in FIGS. 3 and 3*a* in which the sealing apparatus is shown, respectively, with the sealing member 29 under tension and under compression as a result of contraction and expansion of the concrete slabs 21.

In FIGS. 4 and 5 possible modifications of the reinforcing metal plates in the anchor pads are illustrated. These modifications can be employed, if desired, with any of the illustrated or described forms of the apparatus, it being understood that the two substantially parallel pads in each case are preferably identical. In FIG. 4, the pad 47 contains adjacent each side edge thereof a longitudinally extending, vertical metal reinforcing plate 49 and, adjacent the bottom of the pad, a longitudinally extending, horizontal plate 51 that extends laterally a major portion of the width of the pad. In FIG. 5, the reinforcing plate or bar 53 in the anchor pad 55 is similar to the channels 33 in FIGS. 1 and 2, but lacks the side leg or flange adjacent the side of the pad 55 removed from the sealing member 29. As is evident, the anchor pads 47 and 55 are, like the pads 26 and 27, provided with wells 35 for mounting nuts and may contain crushed rock fragments 28. The modifications of FIGS. 4 and 5 are particularly useful when the sealing apparatus is subjected to multi-directional changes or when cost or weight reduction is essential.

Figure 7:
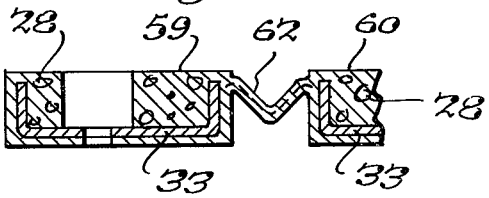

In FIGS. 6 and 7, the structure of the anchor pads 59 and 60 is substantially identical with that of the pads 26 and 27 shown in FIGS. 1 and 2. However, instead of employing a tubular sealing member between the pads as shown in the latter-mentioned figures, a single, flexible, resilient web is used as a sealing member. As shown in FIG. 6, the sealing member 61 is relatively thin compared to the pads, is integrally joined to the spaced anchor pads adjacent the bottoms thereof, and is shaped, in cross section when unstressed, as an upwardly extending arch. The sealing member 62 in FIG. 7 is similar to the member 61 in FIG. 6 but is joined to the spaced anchor pads 59 and 60 adjacent the tops thereof and consequently is shaped, in cross section when unstressed, as a depending arch. As with the anchor pads 26 and 27, the pads 59 and 60 contain embedded hard rock fragments 28 and channel-like reinforcing metal members 33. The structures of FIGS. 6 and 7 are particularly useful in sealing joint gaps in which relative vertical movement of the adjacent concrete slabs is likely to occur. As is evident, the webs 61 and 62 do not offer any resistance to a wide range of such movement while they maintain perfect sealing between the pads without undue stress on the webs.

The joint-gap sealing apparatus of the present invention is preferably made by molding it in sections of desired length, although in some cases the apparatus can be formed by extrusion. Since the lengths of the joint gaps to be sealed vary, it is in most instances convenient to mold the apparatus in sections of standard length and join the lengths or sectons end-to-end as necessary to seal the gap rather than to mold a section of the apparatus that extends the full length of the gap to be sealed. The sections of sealing apparatus can be of any desired length and sections of different lengths can be combined. In some cases it will be possible to form long lengths of the apparatus by a continuous molding process.

FIGS. 8 – 14, inclusive, illustrate means by which sections of joint-gap sealing apparatus according to the invention can be joined in longitudinal array so that leakage between the sections is prevented.

Figure 8:
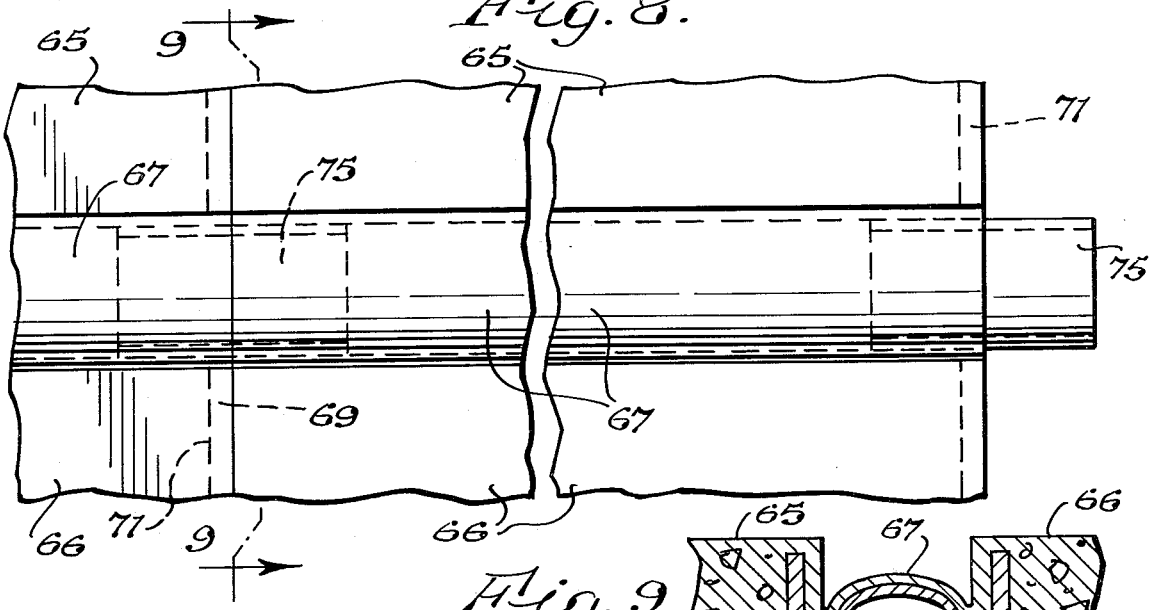
FIG. 8 is a fragmentary, enlarged, plan view illustrating means for preventing leakage between sections of the sealing apparatus illustrated in FIG. 1.
Figure 9:
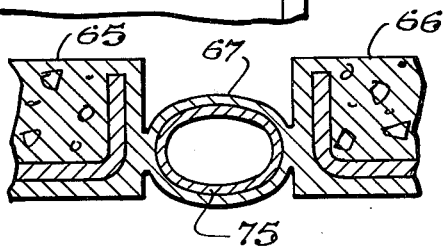
FIG. 9 is a fragmentary, sectional view taken on line 9—9 of FIG. 8.
Figure 12:
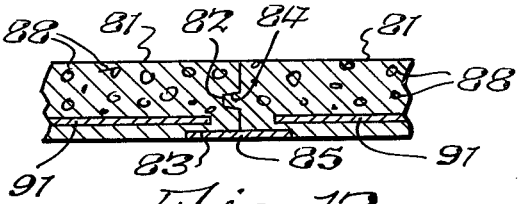
FIG. 12 is a fragmentary, reduced sectional view taken on line 12—12 of FIG. 10.

FIGS. 8 and 9 show, in a top plan view and sectional view, respectively, a joint between two longitudinally arranged, abutting sections of the sealing apparatus. Each section comprises a pair of spaced, parallel anchor pads 65 and 66, integrally joined by a tubular, flexible, sealing member 67. The pads and sealing members may be substantially identical in construction to those shown in any of FIGS. 1 – 5, except as hereinafter described. Each of the anchor pads 65 and 66 is formed at one end with a rib or tongue 69 and at the other end with a groove 71 of a shape and size corresponding to the rib 69. Thus, when placed end-to-end in abutting relation, the tongue 69 of one pad is received in the groove 71 of the abutting pad. This insures good sealing between the abutting pads. To seal the abutting ends of the flexible, sealing members 67 of the sections, relatively short pieces 75 of smaller tubing are inserted into said abutting ends. The tubing pieces 75 are of such size in cross section as to fit tightly in the ends of the members 67 and can be held in place by a suitable adhesive which provides additional sealing around the pieces 75. In FIG. 12 it can be seen how the tongue and groove arrangement referred to above appears in cross section. As indicated above, the anchor pads 65 and 66 contain embedded fragments of crushed stone and longitudinally extending reinforcing bars.

Figure 10:
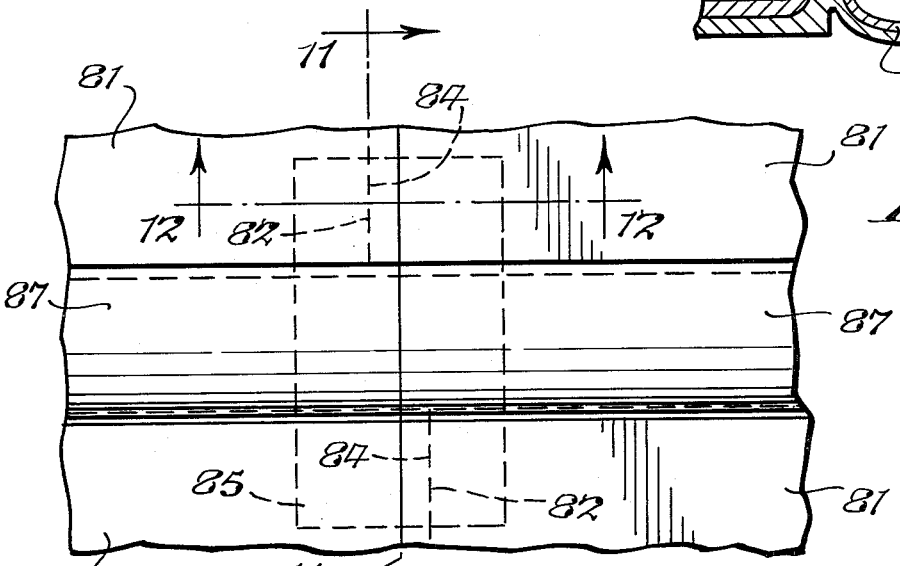
FIG. 10 is a fragmentary, enlarged, plan view illustrating variations in the means for preventing leakage between sections of the sealing apparatus.
Figure 11:
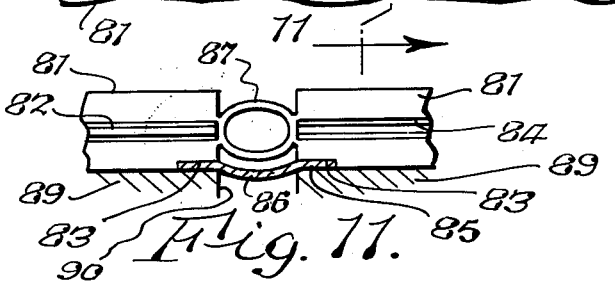
FIG. 11 is a fragmentary, reduced, sectional view taken on line 11—11 of FIG. 10.

In FIGS. 10 – 12, inclusive, another sealing arrangement for abutting ends of sections of the sealing apparatus of the invention is illustrated. In these figures, the anchor pads 81 are identical and have, at the ends of each pad in a section of apparatus, cut-out portions forming notches 83 on the bottom inside corners thereof. A flexible, elastomeric sealing gland 85 is secured in the notches 83 by a suitable adhesive and is also preferably secured by adhesive to the abutting concrete slabs 89. At each joint gap, the sealing gland 85 extends across the gap 90 between the adjacent concrete slabs under the abutting ends of the tubular, flexible, sealing member 87 which is integrally formed with the anchor pads 81. Thus, leakage through the joint between the sections of sealing apparatus is prevented. The glands 85, as shown in FIG. 11, are provided with a downwardly bulging portion 86 under the sealing member 87 to prevent stresses therein when the concrete slabs 89 contract. Sealing of the abutting ends of the anchor pads 81 is obtained by a matching tongue and groove arrangement. Because, however, the pads on both sides of the member 87 are identical, each section of sealing apparatus will have a tongue 82 on one pad and a groove 84 on the other at each end of the section. Thus, the sections can be placed end-to-end and sealed without having to match ends. As in other embodiments, the anchor pads 81 contain fragments of crushed stone 88 and longitudinal reinforcing plates 91.

It will be understood that the abutting ends of sections of sealing apparatus according to the present invention which, as shown in FIGS. 6 and 7, utilize a thin flexible sealing web to integrally join the anchor pads located on opposite sides of a concrete joint gap, may be sealed in the manner just described. An alternative method sealing joints in flexible web portions of the type illustrated in FIG. 6 is shown in FIGS. 13 and 14.

FIG. 13 illustrates, in a separated or exploded plan view, joint-gap sealing apparatus which comprises a pair of spaced anchor pads 92 and 93 joined by a thin, flexible, resilient sealing member 94, which is substantially identical with the member 61 in FIG. 6, and preferably is integral with the anchor pads. The latter are provided with horizontal tongues or ribs 95 on one end of each, which cooperate with horizontal grooves 97 on the adjacent end of abutting anchor pads to insure sealing where anchor pads are longitudinally joined for sealing a long joint gap. Further, at each end of the sealing apparatus sections there are notches 99 cut in the facing edges of the anchor pads into which a short section of flexible, impermeable webbing or membrane 101 can be inserted to cover the discontinuity in the sealing members 94 where they abut. The membrane section 101 is curved to fit closely to the sealing members 94 and may be secured thereto by suitable adhesive. In FIG. 14 the end of a section of joint sealing apparatus is shown with a membrane section 101 protruding therefrom.

Joint sealing apparatus according to the present invention is preferably molded in sections of convenient length. The anchor pads are relatively hard and wear-resistant. Preferably, a suitable elastomer of at least 50 – 60 durometer hardness is employed and, as mentioned above, the wear-resistance and hardness can be increased by embedding particles of crushed stone in the elastomer from which the pads are molded. Such particles are preferably of such size that substantially all pass a No. 3 sieve and are held on a No. 7 sieve, both U.S. Standard Sieve Series. The stone particles may be mixed throughout the elastomer or be embedded only in the portion of the anchor pads adjacent the upper surfaces thereof. When no crushed stone is used, the elastomer should have a durometer hardness of at least about 80. Suitable elastomers include rubber, neoprene, and ethylene-propylene rubber (E.P.D.M). The flexible, resilient sealing members between the pads are of much softer elastomeric material, preferably a low-crystallization neoprene, and may, if desired, have suitable reinforcing material, such as a fabric, incorporated therein.

Installation of gap-sealing apparatus according to the present invention is quite easy since the sections of the apparatus can be handled conveniently. In such installation, the anchor pads are placed on the concrete, on opposite sides of the gap in the roadway to be sealed, with studs mounted in the concrete extending up through holes in the bottoms of the pads. Nuts are then screwed on the studs. In the event the concrete slabs are to be surfaced with asphalt, the facing recesses in the adjacent edges of the slabs may be unnecessary and the anchor pads may serve as dams for the asphalt on each side of the joint. Preferably, a suitable adhesive, several types being well known, is used in addition to the studs and nuts for securing the anchor pads in place. The adhesive also serves as a bedding material for the anchor pads. The spaces around the nuts in the anchor pads are preferably filled with a suitable material such as a rubber-asphalt sealant or an epoxy-rubber mix.

The novel structure of the invention makes possible easy installation even when the gaps between adjacent pavement slabs vary in size during the course of installation. Installation of gap-joint sealing devices of other types under such a condition is very difficult, if not impossible. In fact, in some cases long waiting periods may be required to obtain conditions suitable for installation. In the devices according to the present invention, the low stresses required to stretch or compress the flexible web or sealing members and the rigidity of the anchor pads, even at end joints therein, make it possible to continue installation during expansion or contraction of the pavement slabs.

There is nothing critical in the dimensions of the anchor pads and they may be changed in size and shape as desired or convenient. Further, it will be evident there is nothing critical in the spacing of the holes provided in the anchor pads for bolting them down. Such holes are preferably molded in the pads during manufacture thereof and can be located with any desired distances between them. Although the matching holes in the reinforcing plates may be drilled after the anchor members are molded, it is preferred to punch or drill such holes prior to molding. The reinforcing plates are preferably completely encased in the elastomer of the anchor pads. They may be located where desired and may be formed of any suitable metal, steel and aluminum being generally preferred depending on the allowable weight-cost situation.

In addition to having the advantages of being substantially noiseless and non-buckling, the joint-gap sealing apparatus of the present invention is resistant to wear and provides good sealing. In this connection, it should be noted that the design is such that the flexible web members do not protrude above the anchor pads and hence are not subjected to wear by traffic. Moreover, the hardness of the materials used in the anchor pad construction minimizes wear of the pads, and such materials and the metal bar reinforcement along the confronting faces of the pads reduces deformation of the pads under load. The sealing of the joint gaps is excellent since, because of the adhesive used in securing the anchor pads to the concrete slabs, there is no leakage around them and, as described above, means is provided for preventing leakage at the abutting ends of sections of the apparatus.

It will be understood that the scope of the present invention is not limited to the specific construction described and illustrated in this application since numerous modifications can be made therein without departing from the spirit of the invention. Consequently, the invention should be construed as broadly as permitted by the appended claims. It will also be understood that the novel sealing device of the present invention is capable of wide use and is not limited to use in roadways and the like.

I claim:

1. Roadway joint-sealing apparatus which comprises a pair of elongated, substantially parallel, anchor pads adapted to be secured, respectively, to the upper surface of a roadway on opposite sides of a joint gap therein, said anchor pads being hard and wear-resistant; a flexible, resilient, sealing member extending longitudinally between said pads and integral therewith, said member being tubular in cross section; said pads and said sealing member being formed of elastomeric material and said pads being much harder than said sealing member; two sections of said apparatus being longitudinally aligned and abutted and a separate, short, flexible tubular member being internally secured in the adjoining ends of said tubular sealing members of said sections.

2. Roadway joint-sealing apparatus as defined in claim 1 wherein each of said pads has a longitudinally extending reinforcing metal plate therein.

3. Roadway joint-sealing apparatus as defined in claim 2 wherein at least a portion of said plate is positioned normal to the top and bottom of said pad.

4. Roadway joint-sealing apparatus as defined in claim 3 wherein said plate is channel shaped in cross section.

5. Roadway joint-sealing apparatus as defined in claim 3 wherein said plate is L-shaped in cross section.

6. Roadway joint-sealing apparatus as defined in claim 3 wherein said plate is one of a plurality of reinforcing plates in each of said pads.

7. Roadway joint-sealing apparatus as defined in claim 1 wherein said anchor pads have rock fragments embedded in said elastomeric material.

8. Roadway joint-sealing apparatus as defined in claim 2 wherein said anchor pads have rock fragments embedded in said elastomeric material.

9. Roadway joint-sealing apparatus as defined in claim 3 wherein said anchor pads have rock fragments embedded in said elastomeric material.

* * * * *

UNITED STATES PATENT AND TRADEMARK OFFICE

CERTIFICATE OF CORRECTION

PATENT NO. : 4,080,086

DATED : March 21, 1978

INVENTOR(S) : Stewart Charles Watson

It is certified that error appears in the above-identified patent and that said Letters Patent are hereby corrected as shown below:

The name of the inventor has been changed to read

Stewart Charles Watson

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*